US006601525B1

(12) United States Patent
Lin

(10) Patent No.: US 6,601,525 B1
(45) Date of Patent: Aug. 5, 2003

(54) INCINERATOR WITH AN ASH CONTROL UNIT

(76) Inventor: Dai-You Lin, No. 1069, Chung-Cheng Rd., Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/135,819

(22) Filed: Apr. 30, 2002

(51) Int. Cl.[7] ..... F23G 5/44; F23J 1/00

(52) U.S. Cl. ..... 110/259; 110/165 R; 110/166; 110/170

(58) Field of Search ..... 110/165 R, 165 A, 110/166 FA, 167, 168, 169, 170 FA, 255, 259; 126/242

(56) References Cited

U.S. PATENT DOCUMENTS

| | | | | | |
|---|---|---|---|---|---|
| 1,957,583 | A | * | 5/1934 | Foresman | 110/171 |
| 2,037,990 | A | * | 4/1936 | Martin | 110/165 |
| 2,069,584 | A | * | 2/1937 | Lorton | 110/13 |
| 2,070,152 | A | * | 2/1937 | Bennett | 110/165 |
| 2,381,200 | A | * | 8/1945 | Blake | 48/87 |
| 2,693,775 | A | * | 11/1954 | Berry | 110/165 |
| 4,126,427 | A | * | 11/1978 | Eales | 48/62 R |
| 4,545,306 | A | * | 10/1985 | Wolfram | 110/247 |
| 4,619,210 | A | * | 10/1986 | Kennedy | 110/234 |
| 4,936,231 | A | * | 6/1990 | Johnson | 110/235 |
| 5,255,615 | A | * | 10/1993 | Magaldi | 110/234 |
| 5,392,719 | A | * | 2/1995 | Wen-Chiang | 110/234 |
| 5,915,309 | A | * | 6/1999 | Nakai et al. | 110/214 |
| 6,202,573 | B1 | * | 3/2001 | Bachik | 110/165 A |

FOREIGN PATENT DOCUMENTS

| | | | | |
|---|---|---|---|---|
| AU | 18496/29 | * | 9/1929 | |
| SE | 1446072 | * | 8/1976 | F23J/1/06 |

* cited by examiner

*Primary Examiner*—Ira S. Lazarus
*Assistant Examiner*—K. B. Rinehart
(74) *Attorney, Agent, or Firm*—Brian T. Sattizahn; McNees Wallace & Nurick, LLC

(57) ABSTRACT

An incinerator includes a furnace with a supporting plate that defines a combustion chamber thereabove and an ash receiving chamber therebelow in the furnace. An ash control unit includes a partitioning member that divides the ash receiving chamber into upper and lower ash chambers and that defines a vertically extending ash channel communicated with the upper and lower ash chambers. A rake is disposed over the partitioning member for stirring and permitting uniform distribution of the high temperature ash on the partitioning member and for moving the high temperature ash into the ash channel. A rotary member is disposed rotatably in the ash channel and is formed with a plurality of angularly spaced apart fins which carry the high temperature ash falling from the upper ash chamber to the lower ash chamber.

3 Claims, 3 Drawing Sheets

INCINERATOR WITH AN ASH CONTROL UNIT

BACKGROUND OF THE INVENTION

1. Field of the Invention

This invention relates to an incinerator, more particularly to an incinerator with an ash control unit that uniformly and effectively distributes and cools ash in an ash receiving chamber of the incinerator.

2. Description of the Related Art

Conventional incinerators for combustion of hull or shell waste of agricultural crops normally include a furnace with a perforated supporting plate that defines a combustion chamber thereabove and an ash receiving chamber therebelow in the furnace. High temperature ash and unburned particles of hull and shell waste are deposited on the supporting plate, and are stirred via a rake disposed above the supporting plate for moving the high temperature ash into the ash receiving chamber via through-holes in the supporting plate. The conventional incinerator is disadvantageous in that the ash deposited in the ash receiving chamber is difficult to collect due to a relatively high temperature thereof and is not uniformly distributed due to blockage of some of the through-holes by the deposited ash and unburned hull and shell waste.

SUMMARY OF THE INVENTION

Therefore, the object of the present invention is to provide an incinerator with an ash control unit that is capable of overcoming the aforesaid drawbacks associated with the prior art.

According to the present invention, an incinerator comprises: a furnace with a supporting plate that defines a combustion chamber thereabove and an ash receiving chamber therebelow in the furnace, the supporting plate being formed with a plurality of through-holes for passage of high temperature ash therethrough; and an ash control unit including a partitioning member that divides the ash receiving chamber into upper and lower ash chambers and that defines a vertically extending ash channel communicated with the upper and lower ash chambers, a rake that is disposed over the partitioning member within the upper ash chamber for stirring and permitting uniform distribution of the high temperature ash on the partitioning member and for moving the high temperature ash into the ash channel, and a rotary member that is disposed rotatably in and that is transverse to the ash channel and that is formed with a plurality of angularly spaced apart fins which carry the high temperature ash falling from the upper ash chamber to the lower ash chamber, thereby retarding discharge of the high temperature ash, which, in turn, cools the high temperature ash as the ash is carried from the upper ash chamber to the lower ash chamber.

BRIEF DESCRIPTION OF THE DRAWINGS

In drawings which illustrate an embodiment of the invention.

DETAILED DESCRIPTION OF THE PREFERRED EMBODIMENT

Figure 1:
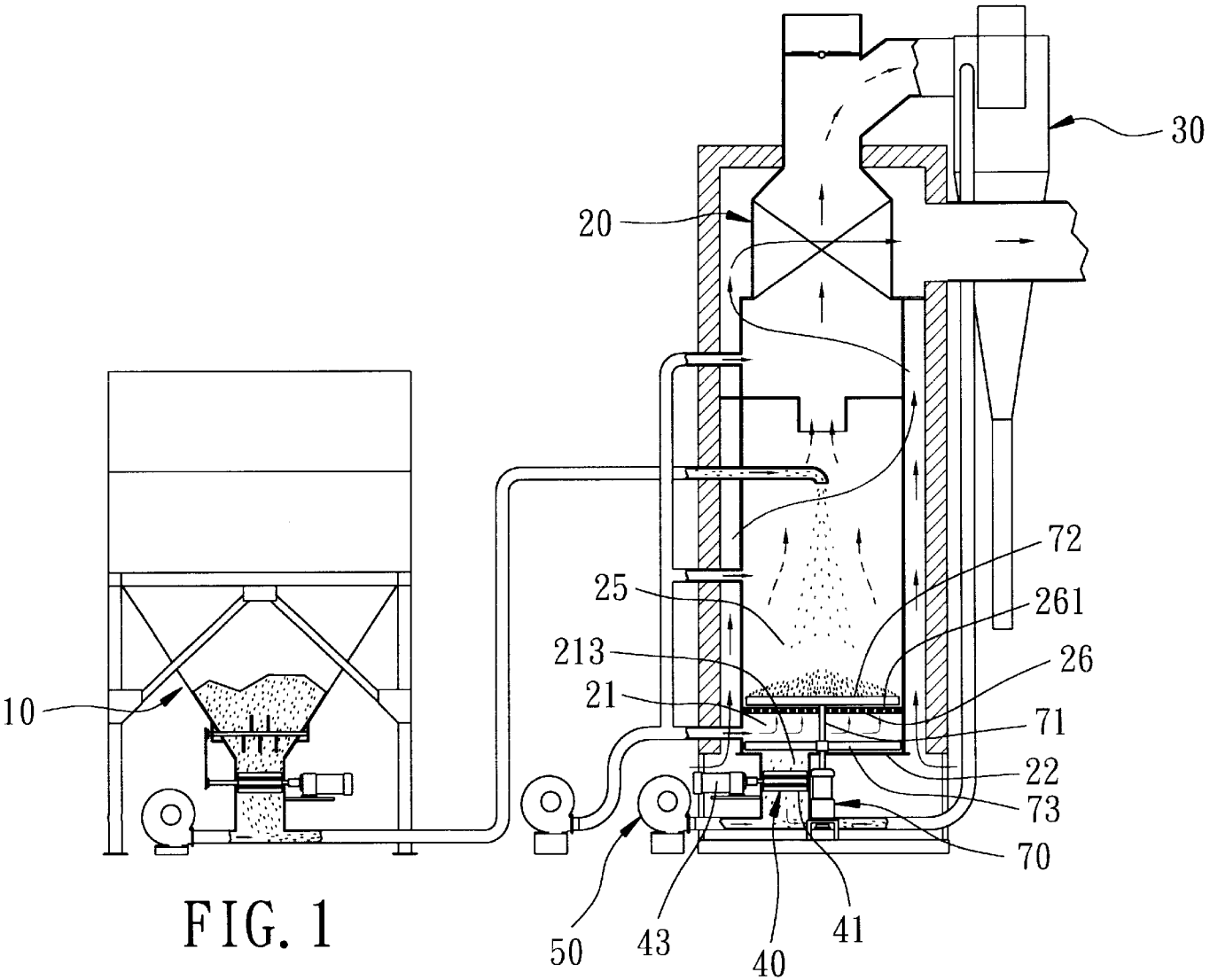
FIG. 1 is a schematic side view of an incinerator embodying this invention.
Figure 2:
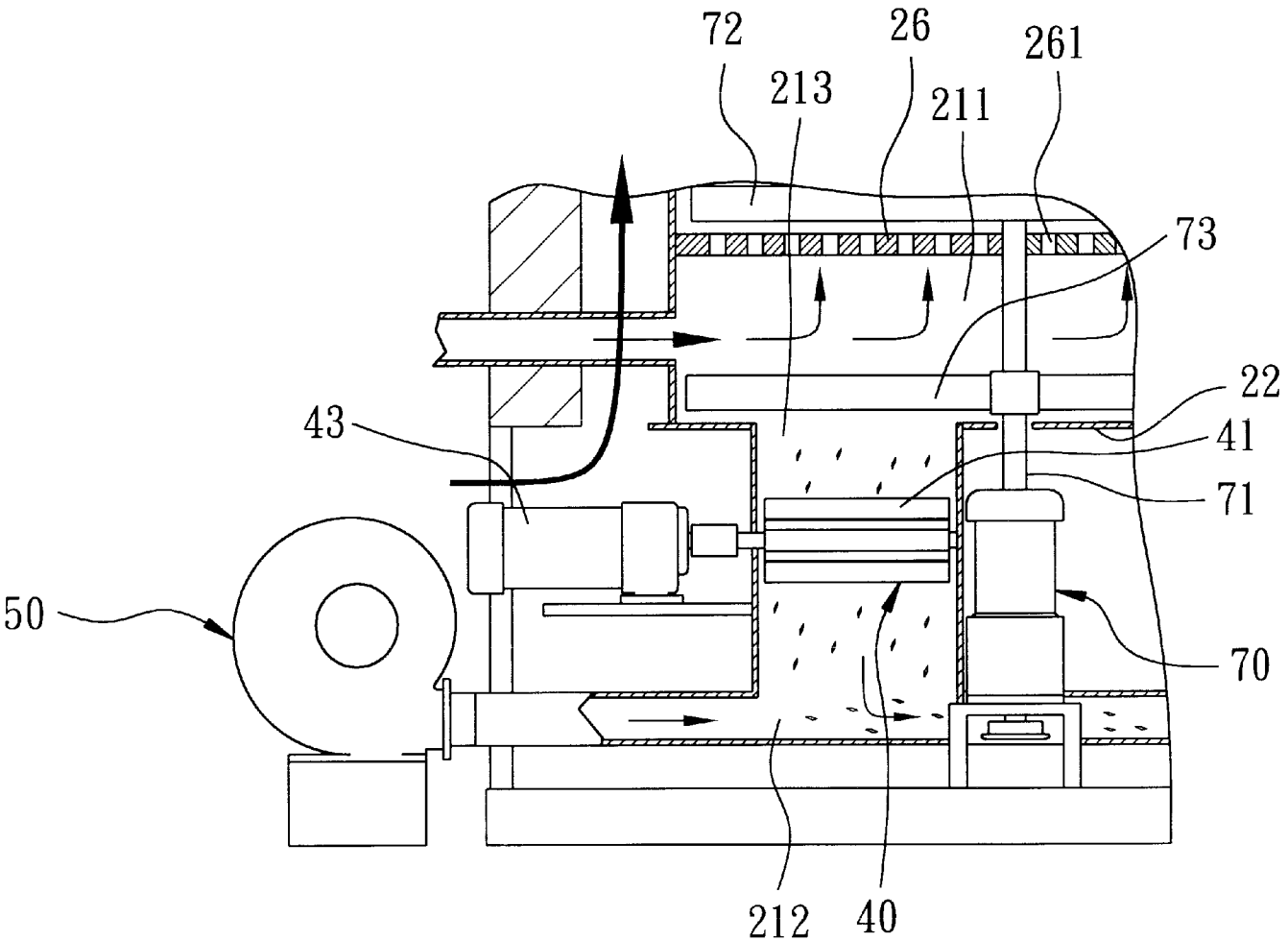
FIG. 2 is a partly sectional schematic side view showing an ash control unit of the incinerator of FIG. 1.
Figure 3:
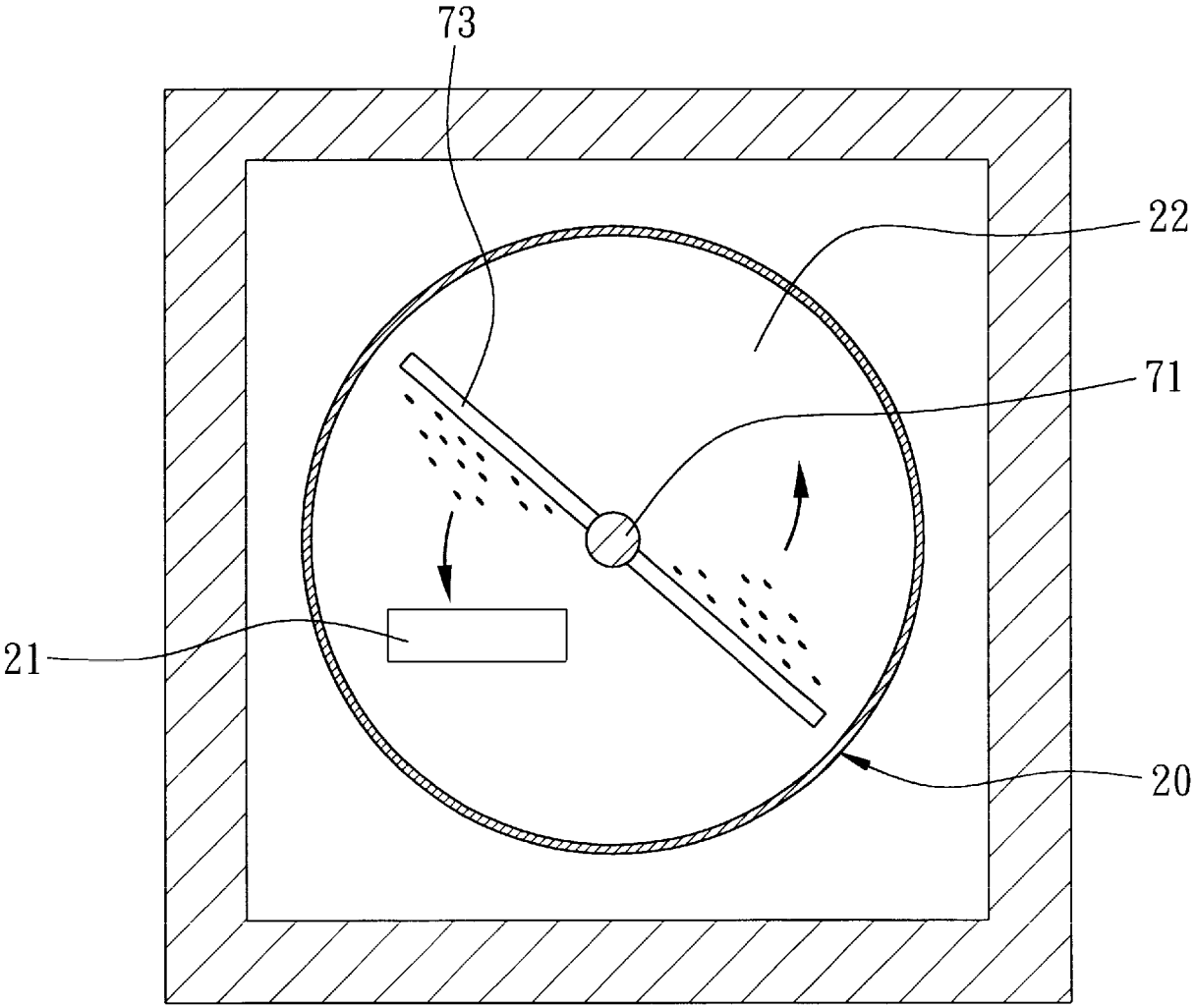
FIG. 3 is a fragmentary sectional schematic top view to illustrate how a rake is operated to move ash into a channel in an ash receiving chamber in the incinerator of FIG. 1.

FIGS. 1 to 3 illustrate a preferred embodiment of an incinerator of this invention for burning raw material, such as hull and shell waste of agriculture crops.

The incinerator includes: a furnace 20 with a supporting plate 26 that defines a combustion chamber 25 thereabove and an ash receiving chamber 21 therebelow in the furnace 20, the supporting plate 26 being formed with a plurality of through-holes 261 for passage of high temperature ash therethrough; and an ash control unit including a partitioning member 22 that divides the ash receiving chamber 21 into upper and lower ash chambers 211, 212 and that defines a vertically extending ash channel 213 communicated with the upper and lower ash chambers 211, 212, a first rake 73 that is disposed over the partitioning member 22 within the upper ash chamber 211 for stirring and permitting uniform distribution of the high temperature ash on the partitioning member 22 and for moving the high temperature ash into the ash channel 213, and a rotary member 40 that is disposed rotatably in and that is transverse to the ash channel 213 and that is formed with a plurality of angularly spaced apart fins 41 which carry the high temperature ash falling from the upper ash chamber 211 to the lower ash chamber 212, thereby retarding discharge of the high temperature ash, which, in turn, cools the high temperature ash as the ash is carried from the upper ash chamber 211 to the lower ash chamber 212. A second rake 72 is disposed rotatably over the supporting plate 26 for stirring the high temperature ash and unburned material on the supporting plate 26 and for moving the high temperature ash through the through-holes 261 and into the ash receiving chamber 21. A motor 43 is provided to rotate the rotary member 40. The first and second rakes 73, 72 are driven by a motor 70 via a shaft 71.

A cyclone separator 30 is in fluid communication with the lower ash chamber 212 for collecting the ash therefrom. An air blower 50 is communicated with the lower ash chamber 212 for pneumatically carrying the cooled ash in the lower ash chamber 212 into the cyclone separator 30.

A feeding device 10 includes a feed container and an air blower for pneumatically transporting the raw material into the combustion chamber 25.

With the inclusion of the ash control unit in the incinerator of this invention, the aforesaid drawbacks associated with the prior art can be eliminated.

With the invention thus explained, it is apparent that various modifications and variations can be made without departing from the spirit of the present invention. It is therefore intended that the invention be limited only as recited in the appended claims.

I claim:

1. An incinerator comprising:

a furnace with a supporting plate that defines a combustion chamber thereabove and an ash receiving chamber therebelow in said furnace, said supporting plate being formed with a plurality of through-holes for passage of high temperature ash therethrough; and an ash control unit including a partitioning member that divides said ash receiving chamber into upper and lower ash chambers and that defines a vertically extending ash channel communicated with said upper and lower ash chambers, a first rake that is disposed over said partitioning member within said upper ash chamber for stirring and permitting uniform distribution of the high temperature ash on said partitioning member and for moving the high temperature ash into said ash channel, and a rotary member that is disposed rotatably in and that is transverse to said ash channel and that is formed with a plurality of angularly spaced apart fins which carry the high temperature ash falling from said upper ash chamber to said lower ash chamber, thereby retarding discharge of the high temperature ash, which, in turn, cools the high temperature ash as the ash is carried from said upper ash chamber to said lower ash chamber.

2. The incinerator of claim 1, further comprising a second rake disposed rotatably over said supporting plate for stirring the high temperature ash and unburned material on said supporting plate.

3. The incinerator of claim 2, further comprising a cyclone separator in fluid communication with said lower ash chamber, and an air blower that is communicated with said lower ash chamber for pneumatically carrying the cooled ash in said lower ash chamber into said cyclone separator.

* * * * *